US007517843B2

(12) United States Patent
Miyamoto et al.

(10) Patent No.: US 7,517,843 B2
(45) Date of Patent: Apr. 14, 2009

(54) METHOD FOR MANUFACTURING SOAP PRODUCTS OF A CONSTANT WEIGHT

(75) Inventors: Yasunori Miyamoto, Tokyo (JP); Tadao Abe, Tokyo (JP)

(73) Assignee: Kao Corporation, Tokyo (JP)

( * ) Notice: Subject to any disclaimer, the term of this patent is extended or adjusted under 35 U.S.C. 154(b) by 1357 days.

(21) Appl. No.: 10/130,605

(22) PCT Filed: Sep. 20, 2001

(86) PCT No.: PCT/JP01/08174

§ 371 (c)(1),
(2), (4) Date: Jun. 27, 2002

(87) PCT Pub. No.: WO02/24427

PCT Pub. Date: Mar. 28, 2002

(65) Prior Publication Data

US 2004/0256010 A1 Dec. 23, 2004

(30) Foreign Application Priority Data

Sep. 22, 2000 (JP) ..... 2000-289623

(51) Int. Cl.
*C11D 17/00* (2006.01)

(52) U.S. Cl. ..... 510/145; 510/447; 510/455; 264/325; 264/328.1; 264/328.7

(58) Field of Classification Search ..... None
See application file for complete search history.

(56) References Cited

U.S. PATENT DOCUMENTS

| | | | | |
|---|---|---|---|---|
| 2,398,776 A | | 4/1946 | Bodman | |
| 4,789,499 A | * | 12/1988 | Bereiter | 530/230 |
| 5,526,677 A | * | 6/1996 | Crawford | 73/32 R |
| 6,010,032 A | * | 1/2000 | Vermylen et al. | 222/1 |

FOREIGN PATENT DOCUMENTS

| | | |
|---|---|---|
| CN | 2030720 | 1/1989 |
| CN | 1057481 | 1/1992 |
| JP | 10-179111 | 7/1998 |
| JP | 10-195494 | 7/1998 |
| JP | 11-43699 | 2/1999 |
| JP | 2000-141445 | 5/2000 |

* cited by examiner

*Primary Examiner*—Necholus Ogden, Jr.
(74) *Attorney, Agent, or Firm*—Oblon, Spivak, McClelland, Maier & Neustadt, P.C.

(57) ABSTRACT

The present invention provides a method for producing a product with a constant weight made from a compressible fluid which comprises feeding the compressible fluid into a prescribed vessel, characterized in that the volume of the compressible fluid to be fed into the vessel is adjusted according to variations of specific gravity of the compressible fluid to be fed into the vessel so that the weight of the compressible fluid to be fed is constant.

22 Claims, 2 Drawing Sheets

1
2
3
4
5
11
12
13
21
22
23
24
31
32
33
34

METHOD FOR MANUFACTURING SOAP PRODUCTS OF A CONSTANT WEIGHT

TECHNICAL FIELD

The present invention relates to a method of producing constant weight products made from a compressible fluid. The production method of the present invention is particularly useful for manufacturing cakes of aerated soap.

BACKGROUND ART

Applicant of the present invention have previously proposed in JP-A-10-195494 a method of producing constant weight products made from aerated molten soap as a kind of a compressible fluid which comprises solidifying molten soap containing a large number of bubbles in a cavity of a mold, wherein the step of solidification is carried out in a hermetically closed cavity.

According to this production method, outside air not being allowed to enter the cavity, the solidified soap is prevented from forming voids or depressions. However, because a given volume of molten soap is fed into the cavity, the density of the molten soap is subject to variation with variations of foaming degree of the molten soap or variations of the liquid level of a storage tank containing the molten soap. It follows that the resulting aerated soaps show scatter in weight even though molten soap is fed in, constant volume portions.

DISCLOSURE OF THE INVENTION

Accordingly, an object of the present invention is to provide a method of producing a product made from a compressible fluid with a constant weight.

The present invention accomplishes the above object by providing a method for producing a product with a constant weight made from a compressible fluid which comprises feeding the compressible fluid into a prescribed vessel, wherein the volume of the compressible fluid to be fed into the vessel is adjusted according to variations of specific gravity of the compressible fluid to be fed into the vessel so that the weight of the compressible fluid to be fed may be constant.

The term "compressible fluid" as used herein is intended to mean a liquid-gas mixed system that reduces its volume without applying high pressure. For example, liquids containing a great number of bubbles are included under this term.

DETAILED DESCRIPTION OF THE DRAWINGS

Figures 3A, 3B, 3C:
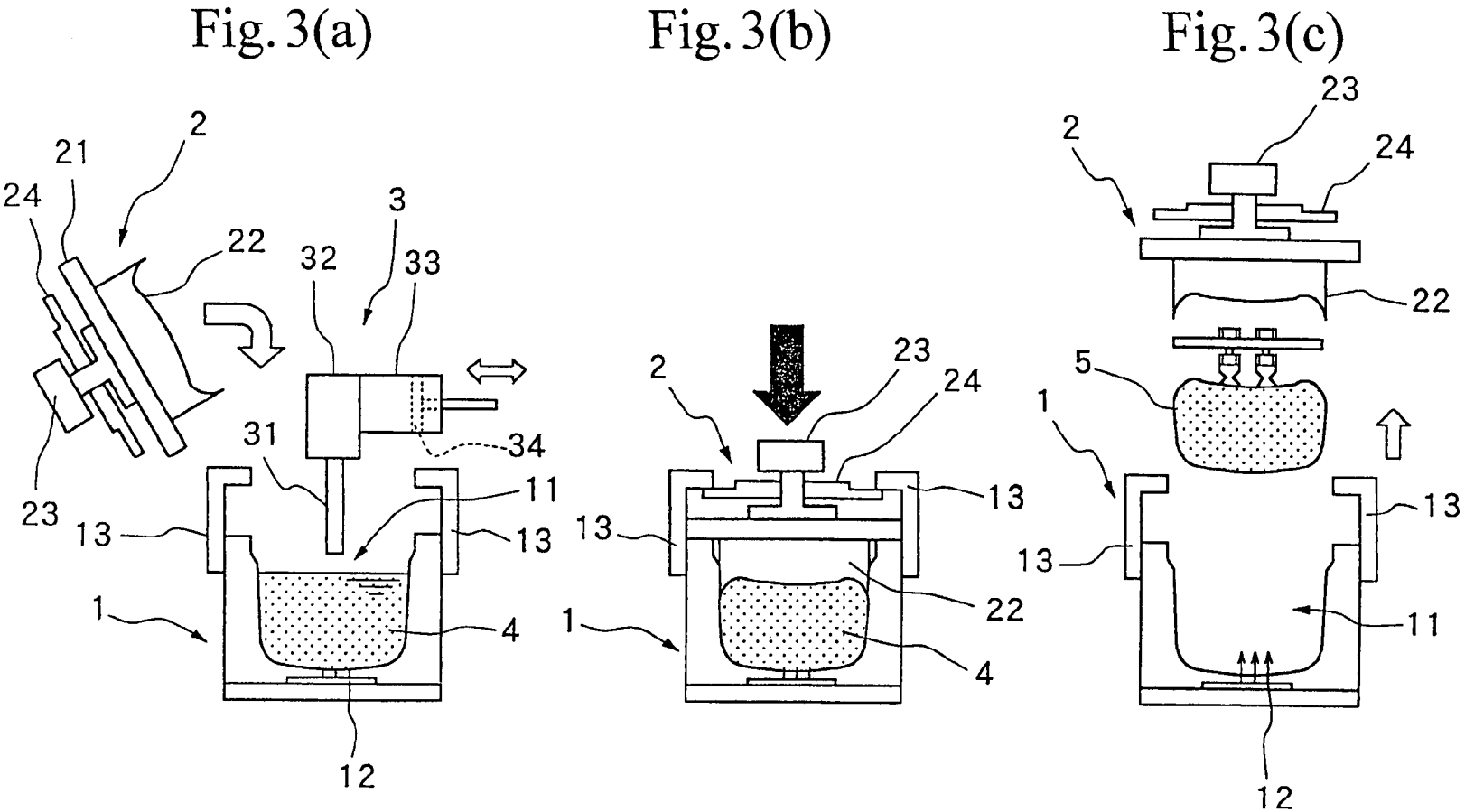

FIG. 3(*a*), FIG. 3(*b*) and FIG. 3(*c*) are sketches of the molten soap molding section of an apparatus used in an embodiment of the production method according to the present invention.

BEST MODE FOR CARRYING OUT THE INVENTION

Figure 1:
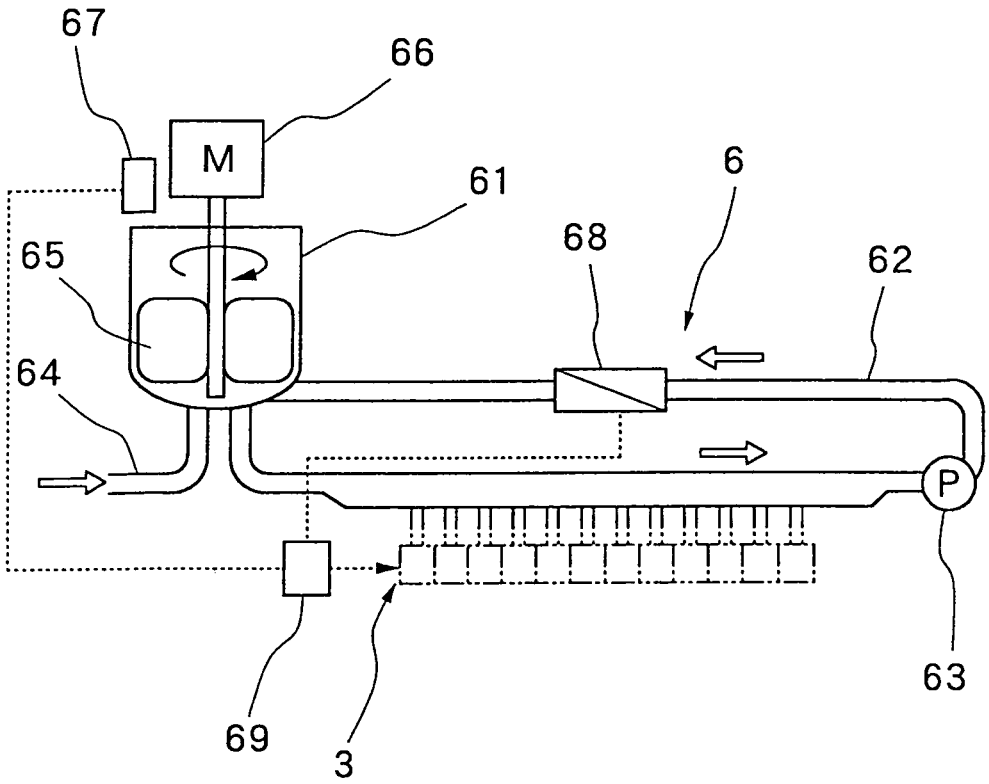
FIG. 1 is a sketch of the molten soap circulating section of an apparatus used in an embodiment of the production method according to the present invention.
Figure 2:
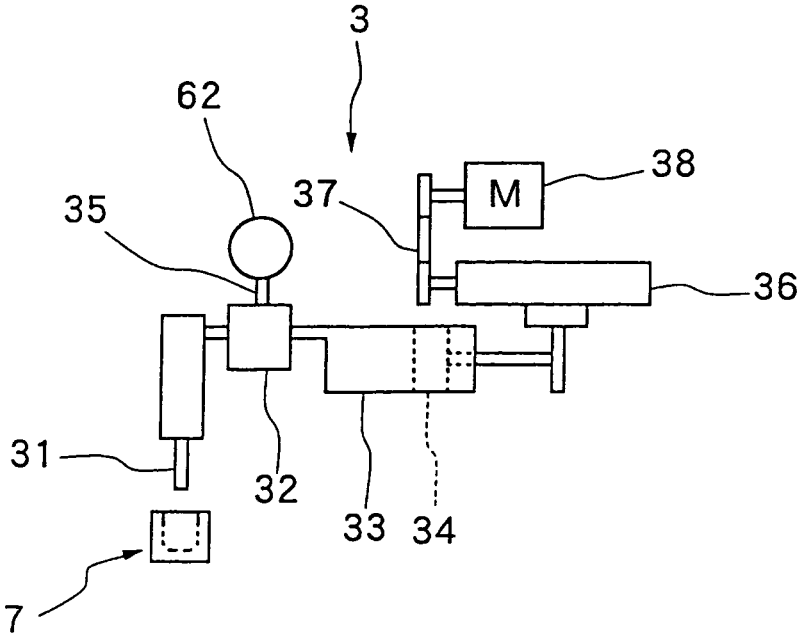
FIG. 2 is a sketch of the molten soap feeding section of an apparatus used in an embodiment of the production method according to the present invention.

The present invention will be described with reference to its preferred embodiment by referring to the accompanying drawings. The embodiment hereinafter described is an example in which cakes of aerated soap are produced as constant weight products from molten soap having a large number of bubbles dispersed therein as a compressible fluid. A production apparatus used in this embodiment has a molten soap circulating section, a molten soap feeding section which is connected to the circulating section, and a molding section having a vessel receiving the molten soap fed from the feeding section. FIG. 1 shows the molten soap circulating section in the apparatus used for the production of aerated soap. FIG. 2 shows the molten soap feeding section, and FIG. 3 shows the molten soap molding section.

The molten soap circulating section 6 shown in FIG. 1 has a storage tank 61, a circulating duct 62 connected to the storage tank 61 and forming a closed loop passing through the storage tank 61, and a circulating pump 63 provided in the circulating duct 62. A feed duct 64 for feeding molten soap having been aerated in a aerating section (not shown) is connected to the storage tank 61. Stirring blades 65 are provided in the storage tank 61. The stirring blades 65 are driven by a motor 66 to revolve in a prescribed direction. A liquid level meter 67 is disposed above the storage tank 61. The liquid level meter 67 which can be used includes optical, ultrasonic or differential-pressure type liquid level sensors. A specific gravity meter 68 is provided in the course of the circulating duct 62. The specific gravity meter 68 which can be used includes, for example, a Coriolis mass flow sensor supplied by Sakura Endless K.K. The specific gravity can be measured in a density measurement mode. To the circulating duct 62 is connected a molten soap feeding section 3, in which the molten soap flow from the circulating duct 62 is switched. Both the circulating section 6 including the storage tank 61 and the circulating duct 62 and the feeding section 3 are maintained at a prescribed temperature with a warming means such as warm water or a heater.

The liquid level of molten soap measured with the liquid level meter 67 and the molten soap density measured with the specific gravity meter 68 are each converted into electrical signals and sent to a computing unit 69, where calculations for controlling the operation of a servo motor 38 are carried out based on the molten soap liquid level and density data, and the calculation results are converted to electrical signals and sent to the servo motor 38.

Circulation of molten soap in the circulating section having the above-mentioned constitution will be described. Molten soap that has been aerated in the aerating section (not shown) to have a large number of bubbles dispersed therein is supplied to the storage tank 61 through the feed duct 64 and stored there. The molten soap is stirred in the storage tank 61 by means of the stirring blades 65 to keep a uniform bubble-dispersed state. Part of the molten soap is delivered to the circulating duct 62 by means of the circulating pump 63. As a result, the molten soap stored in the storage tank 61 circulates through the circulating duct 62 while passing through the storage tank 61. By this circulation the molten soap is prevented from stagnating in the feed piping even when the operation of aerated soap production is suspended in case of any trouble, whereby separation of the aerated molten soap into gas and liquid is avoided. Separation into gas and liquid is suppressed to some extent by the stirring with the stirring blades 65 in the storage tank 61, which cannot be seen as sufficient.

While the molten soap circulates, its density is measured with the specific gravity meter 68 and, at the same time, the molten soap liquid level in the storage tank 61 is measured with the liquid level meter 67.

Molten soap having a great number of bubbles dispersed therein can be prepared by, for example, the method described in JP-A-11-43699, filed by the present applicant, col. 2, line 15 to col. 5, line 1. Various gases are useful for aerating molten soap. In particular, an inert gas, especially a non-oxidizing inert gas such as nitrogen gas, is effective to prevent the molten soap components from being oxidatively decomposed on heating to generate offensive odors, etc. Use of an inert gas for aeration is particularly effective where a perfume component susceptible to oxidative decomposition is compounded as a component of aerated soap.

It is preferred that the molten soap be maintained at a temperature of 55 to 80° C., particularly 60 to 70° C., while being circulated to prevent the molten soap from solidifying at the tip of feed nozzles hereinafter described and to prevent oxidation of soap and deterioration of perfume.

In this connection, the molten soap, while circulated, is preferably heated to and maintained at a temperature higher than the melting point by 1 to 20° C., particularly 2 to 5° C., for the same reason.

Circulation of the molten soap is preferably such that the ratio of the storage tank 61 capacity S ($m^3$) to the circulating flow rate V ($m^3$/hr), S/v ratio (hr), be in the range of from 0.01 to 5 in order to prevent bubbles' gathering and separation into gas and liquid.

In connection to the circulating flow rate, the molten soap is preferably circulated in the circulating duct 62 at a flow velocity Vd of 0.02 to 5 m/s, particularly 0.05 to 0.8 m/s. Below the lower limit, a pressure drop occurs easily when the molten soap is dispensed to the feeding section 3. Above the upper limit, the equipment must have an increased scale, and there is a high possibility that the molten soap entraps air bubbles while circulated. For the same reasons, the circulating duct 62 preferably has a cross sectional area of 10 to 200 $cm^2$, particularly 20 to 180 $cm^2$.

The molten soap being circulated preferably has a shear rate of 0.2 to 500 $s^{-1}$, particularly 0.3 to 100 $s^{-1}$, especially 0.3 to 20 $s^{-1}$, to prevent bubbles' gathering and separation into gas and liquid. The shear rate D is calculated from D=2Vd/d, wherein Vd is a circulating flow velocity (m/s) of the molten soap, and d is the diameter (m) of the circulating duct 62. It is preferred to appropriately dispose a static mixer in the circulating duct for applying shear within the above shear rate range.

Part of the molten soap circulating in the circulating duct 62 is dispensed to the feeding section 3 connected to the circulating duct 62. The feeding section 3 is equipped with a metering means for measuring the volume of the compressible fluid to be fed to the molding section. A prescribed volume of the compressible fluid is measured out and fed to the molding section by the metering means. More specifically, the feeding section 3 has a connecting pipe 35 one end of which is connected to the circulating duct 62, a switch valve 32 connected to the other end of the connecting pipe 35, an injection nozzle 31 connected to one end of the switch valve 32, a cylinder 33 connected to the other end of the switch valve 32, and a piston 34 disposed in the cylinder 33. The cylinder 33 and the piston 34 make up the above-described metering means. The switch valve 32 switches on and off the connection between the circulating duct 62 and the injection nozzle 31. The rod of the piston 34 has a linear guide 36 attached to the rear end thereof. The linear guide 36 is connected to the servo motor 38 via a linking mechanism 37. The motor 38 imparts a linear and reciprocal motion to the linear guide 36 to cause the piston 32 to slide back and forth in the cylinder 33. The volume of the molten soap to be fed is metered based on the travel of the piston 34, e.g., the moving distance in a pulling or pushing movement. Specifically, the volume to be fed is measured out by (1) a method in which the piston position before suction is taken as an origin, and the feed volume is measured from the pull-back distance of the piston or (2) a method in which the piston position after suction is taken as an origin, and the feed volume is measured from the push distance of the piston. Since the molten soap to be metered is a compressible fluid, it is preferred for obtaining improved precision of measured weight to use the method (1) and decide the origin so that the amount of the molten soap remaining in the cylinder when the piston is at the origin may be minimized. The servo motor 38 is controlled based on the calculations in the computing unit 69 as stated above. The details of the control will be described later.

The molten soap flow in the feeding section 3 will then be described. On switching the switch valve 32, part of the molten soap circulating in the circulating duct 62 is delivered into the cylinder 33 through the connecting pipe 35 and the circulating duct 62. At this time, the piston 34 may have been pulled back to a prescribed position by the linear guide 36. Alternatively, the piston 34 may be pulled back gradually with the molten soap feed into the cylinder 33.

On dispensing a prescribed amount of the molten soap to the cylinder 33., the flow is switched over by the switch valve 32 to connect the cylinder 33 and the injection nozzle 31. Then, the piston 34 is pushed over a prescribed distance by the linear guide 36 to push the molten soap out of the cylinder 33, whereby the molten soap is fed to the molding section 7 through the injection nozzle 31. There are provided as many molding sections 7 as the injection nozzles 31. The above-described series of operations are carried out in every feeding section 3.

The travel of the piston 34 is decided under control by the servo motor 38 based on the calculations from the molten soap density measured with the specific gravity meter 68 and the molten soap liquid level in the storage tank 61 measured with the liquid level meter 67. More specifically, the following operations are performed.

As for the molten soap density, the correlation between a weight A of the molten soap fed to the molding section 7 and a density ρ of the molten soap is obtained beforehand. The present inventors' study have revealed that these variables depict an ascending linear plot. A coefficient obtained from this linear relationship is taken as $C_\rho$. In the similar manner, the correlation between a soap weight A fed to the molding section 7 and the molten soap liquid level L is obtained beforehand. The present inventors' study have also revealed that these variables depict an ascending linear plot. A coefficient obtained from this linear relationship is taken as $C_L$. The molten soap weight $A_0$ that is to be fed to the molding section 7 is previously set. The density $\rho_0$ and the liquid level $L_0$ of the molten soap which correspond to the set weight $A_0$ are previously obtained from the above-described linear relationships. These $C_\rho$, $C_L$, $A_0$, $\rho_0$, and $L_0$ values are inputted in the computing unit 69 as initial values.

Then the difference between $\rho_m$ and $\rho_0$ ($\Delta\rho=\rho_m-\rho_0$) and the difference between $L_m$ and $L_0$ ($\Delta L=L_m-L_O$) are calculated in the computing unit 69 based on the previously obtained $\rho_0$ and $L_0$ values and the molten soap density $\rho_m$ and liquid level $L_m$ obtained by measurement. The calculated Δρ and ΔL are each multiplied by the respective constants, $C_\rho$ and $C_L$, inputted as initial values to obtain a weight corrected from the set weight $A_0$, i.e., ($C_\rho\Delta\rho+C_L\Delta L$). Division of the corrected weight by the measured density $\rho_m$ gives a corrected volume. The cross sectional area of the cylinder 33 being known, the corrected volume is divided by the cross sectional area to give a corrected travel of the piston 34. The thus calculated corrected travel is converted to a rotation step of the servo motor 38, and the converted value is sent to the servo motor 38 to control the piston 34 travel.

By this series of operations a constant weight of the molten soap can be fed to the molding section 7 irrespective of molten soap density variations made by some cause. Further, since the molten soap is kept circulated, it does not stagnate in the course from aerating to feeding in case of suspension of the operation and is thereby prevented from separating into gas and liquid. As a result, the resulting aerated soap have bubbles uniformly dispersed therein and lathers well on use.

Molding of the molten soap fed to the molding section 7 is illustrated by referring to FIGS. 3(*a*) to 3(*c*). As shown in FIG. 3(*a*), the molding section has a lower mold 1 and an upper mold 2 making a mold. The lower mold 1 is made of a rigid material such as metal and has a cavity 11 facing up. The cavity 11 is a vessel for holding the molten soap and has a concave shape in agreement with the bottom and sides of an aerated soap as a product. A plurality of interconnecting holes 12 are made in the bottom of the cavity 11 which interconnect the cavity 11 and the outside of the lower mold 1. A clamping mechanism 13 is attached to the sides of the lower mold 1 which clamps the lower mold 1 and the upper mold 2.

The upper mold 2 is also made of a rigid material such as metal. The upper mold 2 is composed of a lid 21, a compressing part 22 which is fitted to the lower side of the lid 21 and the lower side of which is shaped to the upper contour of the aerated soap, a pressing part 23 fitted to the upper side of the lid 21, and a fitting part 24 which is fitted to the pressing part 23 with play and engaged with the clamping mechanism 13 of the lower mold 1.

As shown in FIG. 3(*a*), molten soap 4 injected from the injection nozzle 31 is supplied into the cavity 11 of the lower mold 1. It is preferred that the volume of the molten soap 4 supplied under the above-described control by the computing unit 69 be at least 1.05, particularly 1.1, times the target volume of an aerated soap as a product. This is favorable for effectively preventing shrinkage or development of sink marks involved by compression of the molten soap (hereinafter described) or cooling of the molten soap. In order to achieve such a relationship, the density of the molten soap is adjusted properly. The upper limit of the molten soap volume to be fed is decided appropriately in accordance with the volumetric proportion of bubbles in the molten soap. For example, where the total volume of bubbles in the molten soap volume is relatively large, the degree of shrinkage on cooling will be high so that the upper limit of the volume to be fed is set relatively high. Where the total volume of bubbles in the molten soap volume is relatively small, on the other hand, since the degree of shrinkage on cooling is not so high, the upper limit of the volume to be fed is set relatively low. Considering that the total volume of bubbles is about 5 to 70% of the molten soap volume in this particular embodiment, the upper limit of the volume to be fed is preferably three times, particularly twice, the volume of an aerated soap. While the volume of molten soap varies depending on pressure and temperature, this term as referred to herein is used to mean the volume at 25° C. under atmospheric pressure.

The feeding temperature of the molten soap into the cavity 11 is practically the same as that of the molten soap circulating in the circulating duct 62.

Upon completion of feeding the molten soap 4, the upper side of the lower mold 1 is closed with the upper mold 2, and the fitting part 24 fitted to the upper mold 2 is engaged by the clamping mechanism 13 attached to the lower mold 1. Thus, the two molds are fixed to make the cavity 11 hermetic. Then, as shown in FIG. 3(*b*), the pressing part fitted to the upper mold 2 is pressed down by a prescribed pressing means (not shown), such as a pressure cylinder, to compress the molten soap in the cavity 11 to a set volume of an aerated soap as a product, and the molten soap is let to solidify in this compressed state. These operations effectively prevent development of shrinkage and sink marks on cooling to provide cakes of aerated soap with satisfactory appearance.

The pressure (gauge pressure) for compressing the molten soap is usually about 0.005 to 0.3 MPa, particularly about 0.05 to 0.2 MPa, while varying according to how many times as much as the set volume of an aerated soap the fed molten soap volume is.

The compression ratio of the molten soap, i.e., the compression ratio of the gaseous components in the molten soap (volume of gaseous components before compression/volume of gaseous components after compression) is preferably 1.08 to 2.5, still preferably 1.1 to 2, from the standpoint of preventing development of shrinkage or sink marks on cooling, reducing the cooling time, and improving productivity. The gaseous components in the molten soap include the gas used for aerating molten soap, steam contained in molten soap, and the like.

The solidification time of the molten soap may be shortened by cooling the lower mold by a prescribed means, for example, a coolant such as water. As a matter of course, spontaneous cooling will do. Where the mold is cooled with water, the water temperature is preferably about 5 to 25° C. for preventing non-uniform dispersion of bubbles on cooling.

The molten soap is preferably solidified so that the resulting cakes of aerated soap may have an apparent density of 0.4 to 0.85 g/cm$^3$, particularly 0.6 to 0.8 g/cm$^3$. This is preferred for securing the fluidity of the molten soap, improving the cooling efficiency, and improving releasability and appearance of the resulting cakes from the cavity 11. Such a solidified state can be achieved by, for example, feeding aerated molten soap made of 55 ml (under atmospheric pressure) of nitrogen gas and 90 ml of a soap composition into the cavity 11 at 64° C., compressing the aerated molten soap to 120 ml, and letting the molten soap to solidify in this compressed state. The method of measuring the apparent density of aerated soap will be described in Examples hereinafter given.

It is also preferred that the molten soap is solidified in such a manner that the proportion of bubbles (pores) having a size of 1 to 300 μm in the total pore volume in the resulting aerated soap (hereinafter referred to as a pore volume fraction) may be 80% or more for improving lathering and preventing the soap from getting sodden or swollen in contact with water. Such a solidified state can be obtained by aerating a soap composition by means of, for example, an aeration apparatus Euromix MDFO supplied by Ebara Corp. at a rotor's rotation speed of 1000 kPa (500 rpm), and solidifying the thus arated molten soap in the cavity by cooling while keeping the molten soap in a compressed state. The method of measuring the pore volume fraction of aerated soap will be described in Examples hereinafter given.

On completion of solidification of the molten soap, the engagement of the clamping mechanism and the fitting part 24 attached to the upper mold 2 is released, and the upper mold 2 is removed as shown in FIG. 3(*c*). The aerated soap is taken out of the cavity 11 of the lower mold 1 by using a prescribed holding means, for example, a vacuum gripper. To facilitate removal of the aerated soap from the mold, gas such as air may be blown into the cavity 11 through the interconnecting holes 12 made in the bottom of the cavity 11.

The weight of the aerated soap thus obtained substantially agrees with the set weight. In addition, the soap contains bubbles dispersed therein uniformly and therefore lathers well. Further, the aerated soap assumes a satisfactory outer appearance with neither shrinkage nor sink marks which may have developed on cooling.

Compounding components which can make up the aerated soap include fatty acid soaps, nonionic surface active agents, inorganic salts, polyols, non-soap type anionic surface active agents, free fatty acids, perfumes, and water. If desired, such additives as antimicrobials, pigments, dyes, oils, and plant extracts, can be added appropriately.

The present invention is by no means limited to the above-described embodiment. For example, while in the present embodiment the volume of the molten soap to be fed is adjusted based on the variations in both the molten soap density and the molten soap liquid level in the storage tank 61, adjustment based only on variations in molten soap density is enough to produce aerated soap of constant weight. This is because the variations in molten soap density is more influential on the variations of molten soap volume than the variations in molten soap liquid level in the storage tank 61. It is, as a matter course, more favorable for precise weight control that the volume of the molten soap to be fed be adjusted based on both parameters.

While the density of the molten soap is measured in the circulating duct 62 between the storage tank 61 and the molding section 3 in the above embodiment, the position of measurement is not limited thereto, and measurement can be made at any other position between the storage tank 61 and the injection nozzle 31. The former position is preferred, though, in view of the stabilized flow of the molten soap which will lead to reduced variations in feed.

While in the above embodiment a plurality of molding sections 3 are connected in series to a single loop of the circulating duct 62, it is possible to connect a plurality of circulating ducts forming the respective loops to the storage tank 61 and to connect one or more than one molding section(s) 3 to the individual circulating ducts. In this case, each circulating duct has one or more than one injection nozzle(s), and as many lower molds as the injections nozzles are used. According to this system, particularly where each circulating duct has one injection nozzle, the number of revolutions of the pump can be adjusted individually unlike the series connection, which brings about the merit that the accuracy of weight to be fed can further be improved.

While in the above embodiment the molten soap is fed to the molding section 3 while being circulated in the circulating section 6, the molding section 3 may be connected directly to the outlet of the storage tank 61 without circulating the molten soap.

While in the above embodiment aerated soaps are produced by the use of the lower mold 1 and the upper mold 2, the lower mold 1 may be a split mold composed of a plurality of pieces according to the contour of a desired aerated soap product.

The method of the present invention is useful for production of articles involving cooling and solidifying a heat-melted compressible fluid containing bubbles, especially production of aerated soap from aerated molten soap, it is also applicable to production of foods, such as ice cream, chocolate, and whipped cream.

EXAMPLE 1 AND COMPARATIVE EXAMPLE 1

Molten soap having a great number of bubbles dispersed therein was prepared by using the compounding components shown in Table 1 below in accordance with the method described in JP-A-11-43699 supra. Nitrogen gas was used for aeration.

TABLE 1

| Compounding Component of Molten Soap | Part by Weight |
|---|---|
| sodium laurate | 30.0 |
| sodium cocoyl isetionate | 2.0 |
| sodium lauroyl lactate | 5.0 |
| polyoxyethylene monolaurate | 2.0 |
| lauric acid | 5.0 |
| glycerol | 20.0 |
| sodium chloride | 1.5 |
| perfume | 1.5 |
| water | 32.0 |

In Example 1 aerated soaps were produced from the prepared molten soap according to the steps shown in FIGS. 1 through 3. The weight of the aerated soap was set at 90 g/cake. The molten soap storage tank 61 had a capacity of 0.2 $m^3$, and the circulating duct 62 had a cross sectional area of 78.5 $cm^2$. The feed volume of the molten soap was calculated based on the push distance of the piston. The circulating temperature, circulating flow rate, circulating flow velocity, and shear rate of the molten soap were as shown in Table 2. In Comparative Example 1, feedback control through measurement of specific gravity and liquid level of the molten soap was not carried out.

The molten soap was fed to the cavity 11 of the lower molds 2 through the respective injection nozzles 31. The upper side of each lower mold 1 was closed with the upper mold 2 to make the cavity 11 hermetic, and the molten soap was compressed to a set volume (120 $cm^3$) by the compressing part 22 of the upper mold 2. In this compressed state the lower mold was cooled with cooling water at 5 to 15° C. for 3 to 15 minutes to solidify.

On completion of solidification of the molten soap, the upper mold was removed. The aerated soap was taken out of each cavity 11 by means of a vacuum gripper while blowing compressed air into the cavity 11 through the interconnecting holes 12 made through the bottom of the cavity 11. There were thus obtained aerated soaps as final products.

The resulting cakes of aerated soap were weighed, and their apparent density was measured according to the following method. The results obtained are shown in Table 2.

Measurement of Apparent Density

A rectangular parallelopiped specimen having known side lengths (e.g., 10 to 50 mm) was cut out of the resulting aerated soap and weighed. The weight was divided by the volume to give the apparent density. The volume was calculated from the three side lengths. The weight measurement was made with an electron balance. The measurement was made at 25° C.±3° C. and a relative humidity of 40 to 70%.

TABLE 2

| | | Example 1 | Comparative Example 1 |
|---|---|---|---|
| Molten Soap | Circulating temp. (° C.) | 64 | 65 |
| | Circulating flow rate V ($m^3$/hr) | 3.3 | 3.3 |
| | Circulating flow velocity Vd (m/s) | 0.12 | 0.12 |
| | Shear rate D ($s^{-1}$) | 1.8 | 1.8 |
| | Injected volume (%) (based on set volume of aerated soap) | 120 | 120 |
| Aerated Soap | Apparent density (g/$cm^3$) | 0.75 | 0.80 |
| | Weight (g) | 90 | 96 |

As is apparent from the results shown in Table 2, the weight of the aerated soaps obtained in Example 1 was virtually the same as the set weight. Further, while not shown in the table, the aerated soaps obtained in Example 1 gave off no offensive odor attributed to heating of the molten soap. To the contrary, the aerated soaps of Comparative Example 1 show a noticeable deviation from the set weight.

INDUSTRIAL APPLICABILITY

According to the production method of the present invention products made from a compressible fluid can be produced with no scatter in weight.

The production method of the present invention is particularly useful for manufacturing articles by cooling solidification of a heated, aerated compressible fluid, such as in the production of aerated soap from aerated molten soap.

The invention claimed is:

1. A method for producing a product with a constant weight made from a compressible fluid which comprises:

feeding the compressible fluid into a prescribed vessel through a circulating duct;

aerating the compressible fluid with a gas, and forming an aerated soap from the compressible fluid;

wherein the volume of said compressible fluid to be fed into said vessel is adjusted according to variations of specific gravity of said compressible fluid to be fed into said vessel so that the weight of said compressible fluid to be fed is constant.

2. The method according to claim 1, wherein said compressible fluid is stored in a storage tank, and the volume of said compressible fluid to be fed into said vessel is adjusted according to variations of the liquid level of said compressible fluid in said storage tank.

3. The method according to claim 2, wherein the specific gravity of said compressible fluid is measured at a position between said storage tank and said vessel.

4. The method according to claim 1, wherein the volume of said compressible fluid to be fed to said vessel which is decided based on the specific gravity of said compressible fluid is measured out by a metering means and fed to said vessel.

5. The method according to claim 4, wherein said metering means has a cylinder and a piston disposed in said cylinder and meters the volume of said compressible fluid to be fed to said vessel based on the travel of said piston.

6. A method for producing a product with a constant weight made from a compressible fluid which comprises feeding the compressible fluid into a prescribed vessel through a circulating duct, wherein the volume of said compressible fluid to be fed into said vessel is adjusted according to variations of specific gravity of said compressible fluid to be fed into said vessel so that the weight of said compressible fluid to be fed is constant, and wherein said compressible fluid is molten soap having a great number of bubbles dispersed therein, and said product is aerated soap.

7. A method for producing a product of constant weight, the method comprising:

feeding a compressible fluid into a vessel through a circulating duct;

aerating the compressible fluid with a gas;

forming an aerated soap from the compressible fluid; and adjusting a volume of the compressible fluid based at least in part on at least one variation in a specific gravity of the compressible fluid, thereby obtaining a constant weight of the compressible fluid.

8. The method according to claim 7, further comprising:

storing the compressible fluid in a tank; and adjusting the volume of the compressible fluid based at least in part on a variation of a level of the compressible fluid in the tank.

9. The method according to claim 7, further comprising measuring the specific gravity of the compressible fluid between a storage tank for the compressible fluid and the vessel.

10. The method according to claim 7, wherein the feeding includes measuring the compressible fluid via a means for metering.

11. The method according to claim 7, wherein the feeding includes measuring the compressible fluid using a metering unit which includes a piston disposed in a cylinder, and wherein an amount of movement of the piston provides a measurement of the volume of the compressible fluid.

12. The method according to claim 1, wherein the compressible fluid includes a plurality of bubbles.

13. A method for producing a product with a constant weight made from a compressible fluid which comprises:

feeding the compressible fluid into a prescribed vessel, aerating the compressible fluid with a gas; and forming an aerated soap from the compressible fluid;

wherein the volume of said compressible fluid to be fed into said vessel is adjusted according to variations of specific gravity of said compressible fluid to be fed into said vessel so that the weight of said compressible fluid to be fed is constant, wherein said compressible fluid is stored in a storage tank, and the volume of said compressible fluid to be fed into said vessel is adjusted according to variations of the liquid level of said compressible fluid in said storage tank.

14. The method according to claim 13, wherein the volume of said compressible fluid to be fed to said vessel which is decided based on the specific gravity and the liquid level of said compressible fluid is measured out by a metering means and fed to said vessel.

15. The method according to claim 13, wherein said metering means includes a cylinder and a piston disposed in said cylinder and said metering means meters the volume of said compressible fluid to be fed to said vessel based on the travel of said piston.

16. A method for producing a product with a constant weight made from a compressible fluid comprising:

feeding the compressible fluid into a prescribed vessel;

aerating the compressible fluid with a gas;

forming an aerated soap from the compressible fluid;

adjusting the volume of said compressible fluid to be fed into said vessel according to at least one variation of specific gravity of said compressible fluid so that the weight of said compressible fluid fed into the vessel is constant;

storing said compressible fluid in a storage tank, and adjusting the volume of said compressible fluid to be fed into said vessel according to variations of a liquid level of said compressible fluid in said storage tank.

17. The method according to claim 1, further comprising heating the compressible fluid.

18. The method according to claim 7, further comprising heating the compressible fluid.

19. The method according to claim 6, wherein said compressible fluid is stored in a storage tank, and the volume of said compressible fluid to be fed into said vessel is adjusted according to variations of the liquid level of said compressible fluid in said storage tank.

20. The method according to claim 19, wherein the specific gravity of said compressible fluid is measured at a position between said storage tank and said vessel.

21. The method according to claim 6, wherein the volume of said compressible fluid to be fed to said vessel which is decided based on the specific gravity of said compressible fluid is measured out by a metering means and fed to said vessel.

22. The method according to claim 21, wherein said metering means has a cylinder and a piston disposed in said cylinder and meters the volume of said compressible fluid to be fed to said vessel based on the travel of said piston.

* * * * *